US005799719A

United States Patent [19]

Wimmer et al.

[11] Patent Number: 5,799,719

[45] Date of Patent: Sep. 1, 1998

[54] CONTINUOUS CASTING MOLD

[75] Inventors: Franz Wimmer, Riedau; Heinrich Thöne, Losenstein, both of Austria

[73] Assignee: Voest-Alpine Industrieanlagenbau GmbH, Linz, Austria

[21] Appl. No.: 750,632

[22] PCT Filed: Apr. 15, 1996

[86] PCT No.: PCT/AT96/00072

§ 371 Date: Apr. 4, 1997

§ 102(e) Date: Apr. 4, 1997

[87] PCT Pub. No.: WO96/33034

PCT Pub. Date: Oct. 24, 1996

[30] Foreign Application Priority Data

Apr. 18, 1995 [AT] Austria ..... A 663/95

[51] Int. Cl.[6] ..... B22D 11/04

[52] U.S. Cl. ..... 164/418; 164/459

[58] Field of Search ..... 164/418, 459

[56] References Cited

U.S. PATENT DOCUMENTS

| | | | |
|---|---|---|---|
| 3,910,342 | 10/1975 | Johnson | 164/459 X |
| 4,023,612 | 5/1977 | Jackson . | |
| 4,207,941 | 6/1980 | Shrum | 164/459 X |
| 4,694,880 | 9/1987 | Gladwin | 164/459 |
| 5,360,053 | 11/1994 | Kawa et al. . | |
| 5,409,053 | 4/1995 | Kawa et al. . | |
| 5,469,910 | 11/1995 | Kawa et al. . | |

FOREIGN PATENT DOCUMENTS

| | | | |
|---|---|---|---|
| 0 179 364 | 4/1986 | European Pat. Off. . | |
| 0 498 296 | 8/1992 | European Pat. Off. . | |
| 34 27 756 | 3/1985 | Germany . | |
| 50-27027 | 9/1975 | Japan | 164/418 |
| 61-49751 | 3/1986 | Japan . | |
| WO93/17817 | 9/1993 | WIPO . | |

OTHER PUBLICATIONS

"Convex approach to faster billet casting", *Steel Times International*, vol. 18, No. 6, Nov. 1994, Redhill, Surrey, GB, pp. 18–19.

*Primary Examiner*—J. Reed Batten, Jr.
*Attorney, Agent, or Firm*—Hill & Simpson

[57] ABSTRACT

A continuous casting mold for casting a billet with a polygonal cross section has side walls delimiting a mold space with a polygonal cross section and the side walls have a center region extending from an open top end to an open bottom or exit end of the mold with a first degree of taper and, at the sides of the center regions, abutting side regions with a lesser degree of taper than the first degree. In order to obtain even growth of the casting shell with low frictional forces, the center region has a degree of taper which is greater than the amount from the billet contraction and the width of the side regions increases as the distance from the exit end of the continuous casting mold decreases.

15 Claims, 1 Drawing Sheet

FIG. 1
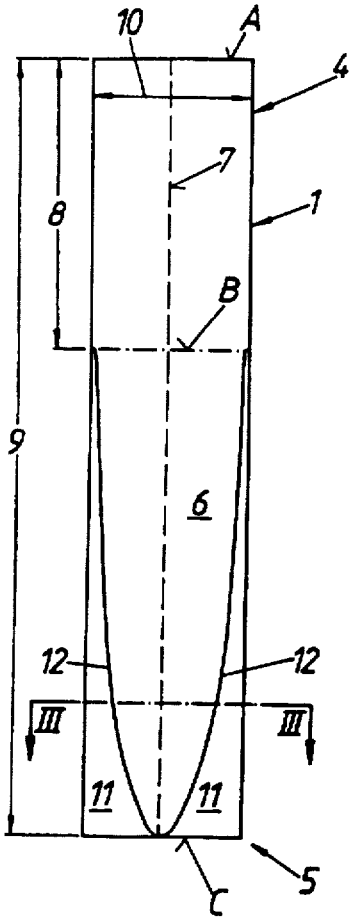
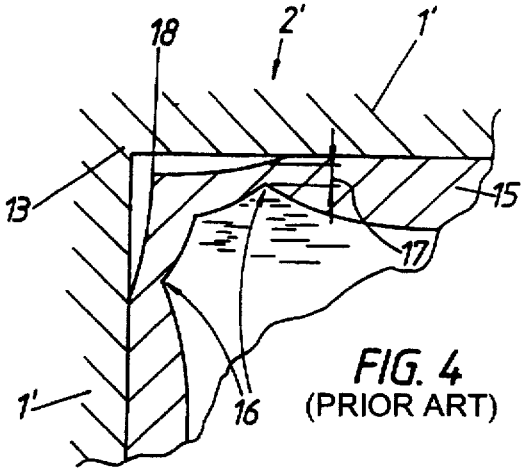
FIG. 4
(PRIOR ART)
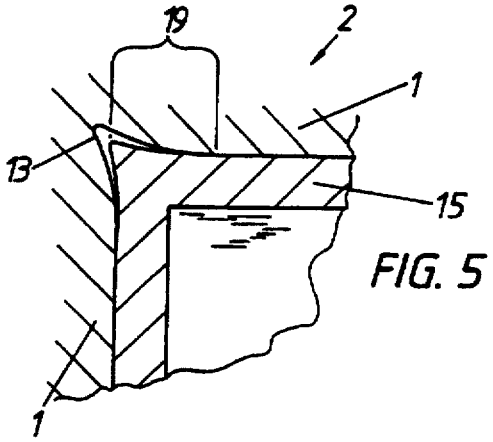
FIG. 5
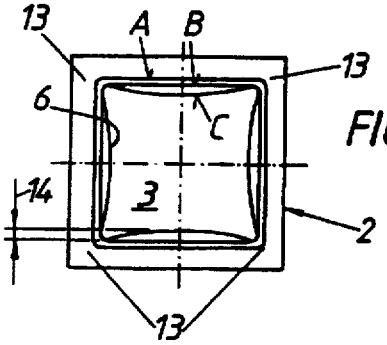
FIG. 2
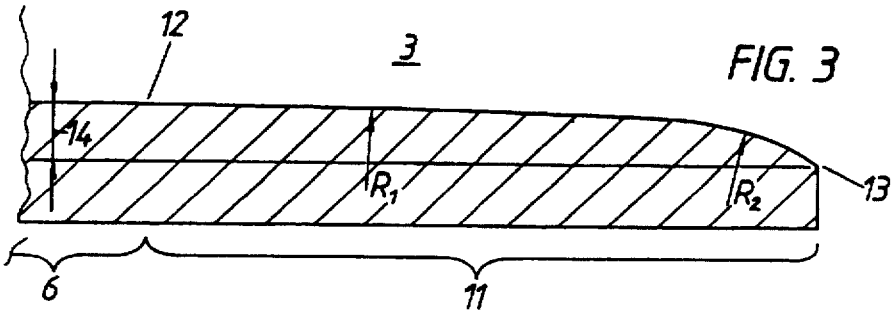
FIG. 3

CONTINUOUS CASTING MOLD

BACKGROUND OF THE INVENTION

The invention relates to a continuous casting mold for casting a strand of polygonal cross section, comprising side walls delimiting a mold cavity of polygonal cross section, wherein side walls have a center region extending in the casting direction and exhibiting a first taper and side regions laterally adjoining the center region and exhibiting a taper that is less than the first taper.

A continuous casting mold of this type is known from EP-A - 0 179 364. According to this document, the interfacial angle between adjacent side walls of the continuous casting mold diminishes in the moving direction of the strand, i.e. in the casting direction, provided that the tensile stresses in the edge region which are caused by the shrinkage of the strand shell continuously diminish and/or compensate each other. Hereby, detaching of the strand shell from the cooled mold wall in the region of the comers is to be avoided with a view to achieving uniform shell growth, particularly a shell having a uniform thickness. This is, however, disadvantageous, namely for the following reason:

In conventional continuous casting molds, a particularly pronounced shell growth results in the edge or corner region of the strand already in the initial solidification phase of the strand, and thus directly below the meniscus, due to the two-dimensional heat transport taking place in the edge region. Hereby, the rigidity of the strand shell in the edge region increases to such an extent that the ferrostatic pressure inside the strand is no longer sufficient for pressing the strand shell against the mold side walls in the edge region. Hence contact loss in the edge region will ensue. Due to this contact loss, further cooling of the strand in the edge region can only be effected by heat radiation, but no longer by heat conduction.

As a consequence, the shell growth will immediately fall short of that of adjacent strand zones which rest against the side walls of the continuous casting mold. Directly at the edge of the strand the cessation of heat transmission is, however, compensated for by heat conduction through two-dimensionally acting heat radiation. Thus, there form zones of weak spots having slighter shell thickness, each closely adjacent to the edges of the strand, said zones of weak spots extending in the longitudinal direction of the strand. These local shortfalls in shell growth lead to the strand shell being inhomogeneous and thus richer in tension and more susceptible to cracking and results in a risk of breakout. As the strand passes through the mold, these weak spots move slightly away from the comer regions of the mold toward the center of the side walls.

Attempts to avoid detachment of the strand shell from the cooled side walls of the mold in the region of the comers by the method described in EP-A - 0 179 364, namely by diminishing the interfacial angle in the casting direction, will first of all cause an increase in the extraction force for the strand due to an enhanced degree of friction. Furthermore, excessive cooling of the edge regions will ensue as contact between the edges of the strand and the comers of the mold is effected along the entire length of the mold—at least theoretically—, leading to a further increase in the frictional forces acting between the strand and the continuous casting mold. If, finally, contact loss does occur in the edge region, the above-described effect, i.e. the formation of local weak spots, will be added.

SUMMARY OF THE INVENTION

The invention aims at avoiding these disadvantages and difficulties and has as its object to provide a continuous casting mold in which uniform shell growth is ensured in conjunction with only slight frictional forces acting between the strand and the continuous casting mold. In particular, lifting off of the strand shell in the edge or corner region of the strand is to be effected so selectively that there will be no more weak spots located adjacent to the edges or corner and any risk of breakout in these regions will be significantly reduced, or even entirely avoided.

In accordance with the invention this object is achieved in that the center region has a taper in excess of a taper adjusted to strand shrinkage and that the width of the side regions is designed such as to increase progressively in the casting direction up to the end of the continuous casting mold.

It is thus rendered feasible to selectively release the edge regions of the strand within the continuous casting mold, whereby frictional forces are reduced and jamming of the strand is reliably avoided. It has emerged that by the membranous bending behavior of the strand shell in the central regions where the strand shell is in contact in the center regions of the side walls of the continuous casting mold, elastic recession of the strand shell is enabled, without, however, entailing a heavy increase in the frictional forces acting between the strand shell and the side walls of the continuous casting mold. The construction according to the invention of the side regions in combination with the center region of the side walls of the continuous casting mold not only makes possible the selective release of the edge region of the strand but also permits to achieve contact of the strand shell in those regions where the above-mentioned local weak spots are incurred in conventional continuous casting molds.

Preferably, the center region extends from the end of the continuous casting mold at least into the meniscus region, wherein suitably the center region is formed by a flat surface and has a constant taper throughout its length.

A heavy increase in the frictional forces acting between the strand shell and the mold side walls is reliably avoided if the center region has a taper in the region of 1.5 to 2.5%/m mold length, preferably in the region of 2 to 2.5%/m mold length.

Preferably, the side regions from the end of the continuous casting mold extend to a point below the meniscus region but into the upper half of the mold, i.e. it is sufficient if the side regions extend only until the approximate point where lifting-off of the strand shell in the edge region occurs for the first time.

According to a preferred embodiment, the side regions are constructed so as to be convexly curved in their cross section, wherein at the transition of the side regions into the center region the side regions and the center region exhibit a common tangential area.

To ensure the release of the edge regions of the strand throughout the lower half of the mold, departing from the transition to the center region up to the corner region the convexly curved cross section of the side regions suitably shows an increased curvature.

A side wall of the continuous casting mold according to the invention can be produced in simple fashion if the convexly curved cross section of the side regions is formed by circular lines having two different radii and exhibiting a tangential transition.

Preferably, the taper of the side regions is less than a taper adjusted to the strand shrinkage.

Sufficient release of the edge regions of the strand is provided if the taper of the side regions in the corner regions of the mold cavity amounts to a maximum of 1.5 to 2.0%/m mold length, wherein advantageously the taper of the side regions amounts to a minimum of 0%/m mold length.

In accordance with the distribution of the weak spots as observed in conventional continuous casting molds, suitably the transitions from the center region to the side regions each depart from corner regions of adjoining side faces of the continuous casting mold and—viewed in the casting direction—approach the symmetrical center line of a side wall in a curved manner, wherein advantageously the curved transitions exhibit a curvature that increases toward the end of the continuous casting mold.

BRIEF DESCRIPTION OF THE DRAWINGS

FIG. 1 is an elevational view of an inner face of a single side wall of a continuous casting mold according to the present invention;

FIG. 2 is a top plan view of the continuous casting mold having four side walls which are illustrated in FIG. 1;

FIG. 3 is an enlarged partial cross sectional view of the single side wall taken on the lines III—III of FIG. 1;

FIG. 4 is an enlarged partial cross sectional view of a corner region of a conventional continuous casting mold illustrating the relationship of the strand and mold walls; and FIG. 5 is an enlarged partial cross sectional view of a corner region of a continuous casting mold according to the present invention illustrating the relationship between the strand and mold walls.

DESCRIPTION OF THE PREFERRED EMBODIMENTS

The side wall 1 represented in FIG. 1 of a continuous casting mold 2 serves for forming a mold cavity 3, illustrated in FIG. 2, having approximately the cross section of a billet or bloom. The side wall 1 is provided with a center region 6 extending from top to bottom, i.e. from an entrance end or open top end of the pouring region 4 to the open bottom or exit end 5 of the continuous casting mold 2, and constructed so as to be symmetrical with regard to the longitudinal center line 7 respectively the symmetrical center line of the side wall 1. This center region 6 is designed roughly in the shape of a tongue, but with the center region extending over the entire width 10 of the side wall 1 in the pouring region 4 and preferably over a region 8 making up slightly more than the first quarter of the longitudinal extent 9 of the side wall 1. At a mold length of roughly 800 mm, that region 8 extends over a length of 200 to 250 mm.

Below this region 8, side regions 11 laterally adjoin the center region 6, wherein the transitions 12 from the center region 6 to the side regions 11—if viewing the side wall 1 from the top—are constructed so as to be curved, with the curvature increasing toward the exit end 5 of the continuous casting mold 2. This results in the width of the side regions 11 increasing in the casting direction continuously and without irregularities; the position of the maximum width being located at the exit end 5 of the continuous casting mold 2.

The center region 6 has a taper in excess of a taper adjusted to strand shrinkage, with the taper effectively amounting to approximately 2 to 2.5%/m mold length 9. The center region 6 is constructed flat-surfaced and the taper of the center region 6 is held constant throughout the length 9 of the side wall 1.

As can be seen particularly from FIG. 3, the side regions 11 are curved convexly toward the mold cavity 3 and tangentially adjoin the center region 6 at the transition 12 so that there is no break in the side wall 1 at the transition 12. The convex arch of the side regions 11 increases toward the corner regions 13 of the mold cavity 3, i.e. it exhibits an increased curvature. For simple production, this increasing curvature—if looking at the cross section of the side wall 1—is realized by means of adjoining circular arcs of different radii $R_1$ and $R_2$, wherein a region having a very large radius $R_1$ adjoins the center region 6 and adjoining this region there is a region having a smaller radius $R_2$. The taper of the side regions 11 is less than the taper of the center region. Suitably it is less than a taper adjusted to the shrinkage of the strand; advantageously it lies between a minimum of 0%/m mold length and 1.5%/m mold length.

In accordance with a preferred embodiment, with a minimum taper of 0%/m mold length of the side-wall parts 11 the extent of the recession 14 of the comer regions 13 relative to the central section 6 at the lower end 5 of the mold 2 at a mold side width 10 of 160 mm and a mold length of 800 mm is roughly 1 mm, with the taper of the center region being 2.5%/m mold length.

In FIG. 2, contours A, B, C of the side walls 1 are shown, which are provided at the upper top end of the pouring region 4 of the mold, at the beginning of the side regions 11 and at the exit end 5 of the continuous casting mold 2.

In accordance with a preferred embodiment, the center region 6 of the side wall 1 can exhibit a higher degree of taper over the region 8 of the mold, along which it extends across the entire width 10 of the side wall 1, than over its remaining length.

What happens in the edge regions of the strand in continuous casting molds of conventional construction is as follows (cf. FIG. 4):

If contact is lost between the strand shell 15 and the side walls 1' of the continuous casting mold 2', the contribution of heat conduction to heat transfer will be lacking there. This only leaves heat exchange by radiation. As a consequence, shell growth will immediately fall behind as compared to adjacent strand zones resting against the side walls 1' of the continuous casting mold 2'. Zones 16 of weak spots having a slighter shell thickness 17 will form, namely each in close vicinity of the edges or corner 18 of the strand. Directly at the edges 18 themselves, cessation of heat conduction is compensated for by two-dimensional carrying-off of radiation heat. Local shortfall of growth leads to the strand shell 15 being inhomogeneous and thus richer in tension and more susceptible to cracking; the local weak spots 16 constitute a risk of breakout.

In the following, the effect of the continuous casting mold 2 according to the invention will be explained:

The excessive taper of the center region 6 makes for a safe contact of the strand shell 15. Especially in the center region, the shell 15 of the strand is of a membranous softness and can therefore without difficulty adjust to the excessive taper present in the center region 6 of the side walls 1.

In accordance with the invention, especially in those areas where the zones 16 of weak spots form, the strand shell 15 is caused to rest against the side walls 1 of the continuous casting mold 2, namely at the side regions 11 of the side walls 1, without, however, causing a contact pressure between the continuous casting mold 2 and the strand shell 15 directly in the corner regions 13. Precisely in this transition area, which is at risk in casting operations with conventional molds, the slighter taper of the side regions 11 in combination with the excessive taper of the center regions 6 causes a safe support and hence good contact and, consequently, heat transmission by heat conduction.

The continuous casting mold according to the invention is to a very large extent insensitive to changes in the casting parameters. It ensures uniform shell growth and allows the release of the edge or corner regions 19 of the strand in which nonetheless no weak shell spots will occur. Hereby, frictional forces acting between the strand shell 15 and the side walls 1 of the continuous casting mold 2 and hence the load on the strand shell are minimized. This also makes for a very slight wear of the mold.

With continuous casting molds which induce a more prolonged contact between the strand shell 15 and the side wall 1 in the corner regions 13, high peaks of contact pressure, direct shell stress and frictional forces ensue in the corner regions 13 of the continuous casting mold —above all in the second half of the continuous casting mold—at changing casting parameters (particularly at low casting speeds). This is avoided in accordance with the invention because there is a slighter taper or none at all in the edge regions 19. Thus, the strand shell 15 in these edge regions 19 from the contour B onwards is imparted, as it were, a degree of freedom and does not cause high pressure peaks to occur, so that the extraction forces for withdrawing the strand from the continuous casting mold are not increased either.

The invention is not limited to the exemplary embodiment illustrated in the drawing but can be modified in various respects. For instance it is feasible to construct the continuous casting mold 2 for different strand cross sections, hence also for bloom cross sections or slab cross sections. Furthermore, the continuous casting mold 2 can be constructed both as a tubular mold and as a plate mold. Its application is not limited to vertical casting. The mold cavity can have a curved central axis.

We claim:

1. Continuous casting mold for casting a strand of polygonal cross section, comprising side walls delimiting a mold cavity of polygonal cross section, each of the side walls having a center region extending in a casting direction from an open top to an open bottom end of the casting mold and exhibiting a first taper and side regions laterally adjoining the center region and exhibiting a second taper that is less than the first taper, the improvement comprising the first taper of the center region being in excess of a third taper expected for strand shrinkage for a cross sectional dimension of the mold cavity and that the width of the side regions being designed to increase progressively in the casting direction to the bottom end of the continuous casting mold.

2. Continuous casting mold according to claim 1, wherein the center region extends from the bottom end of the continuous casting mold at least into a meniscus region of the casting mold.

3. Continuous casting mold according to claim 1, wherein the center region is formed by a flat surface.

4. Continuous casting mold according to claim 1, wherein the center region has a constant taper throughout its length.

5. Continuous casting mold according to claim 1, wherein the first taper of the center region is in a range of 1.5 to 2.5%/m of a length of the mold. the region of 2 to 2.5%/m mold length.

6. Continuous casting mold according to claim 1, wherein the first taper of the center region is in a range of 2 to 2.5%/m of a length of the mold.

7. Continuous casting mold according to claim 1, wherein the side regions are constructed so as to be convexly curved in their cross section.

8. Continuous casting mold according to claim 7, wherein at a transition of the side regions into the center region the side regions and the center region exhibit a common tangential area.

9. Continuous casting mold according to claim 7, wherein departing from a transition to the center region up to a corner region of the mold, a convexly curved cross section of the side regions shows an increased curvature.

10. Continuous casting mold according to claim 9, wherein the convexly curved cross section of the side regions is formed by circular lines having two different radii and exhibiting a tangential transition.

11. Continuous casting mold according to claim 1, wherein the second taper of the side regions is less than the third taper and in corner regions of the mold cavity amounts to a maximum of 1.5 to 2.0%/m of a length of the mold.

12. Continuous casting mold according to claim 1, wherein the second taper of the side regions amounts to a minimum of 0%/m mold of the length.

13. Continuous casting mold according to claim 1, wherein transitions from the center region to the side region each depart form corner regions of adjoining side walls of the continuous casting mold and when viewed in the casting direction approach a symmetrical center line of a side wall in a curved manner to form curved transitions.

14. Continuous casting mold according to claim 13, wherein the curved transitions exhibit a curvature that increases toward the bottom end of the continuous casting mold.

15. Continuous casting mold according to claim 1, wherein the side region extend from the bottom end of the continuous casting mold to a point in an upper half of the mold but below a meniscus region of the mold.

* * * * *